US007552769B2

(12) United States Patent
Cherewyk

(10) Patent No.: US 7,552,769 B2
(45) Date of Patent: Jun. 30, 2009

(54) PACKOFF NIPPLE

(75) Inventor: Boris (Bruce) P. Cherewyk, Calgary (CA)

(73) Assignee: Isolation Equipment Services Inc., Red Deer (CA)

( * ) Notice: Subject to any disclaimer, the term of this patent is extended or adjusted under 35 U.S.C. 154(b) by 201 days.

(21) Appl. No.: 11/164,126

(22) Filed: Nov. 10, 2005

(65) Prior Publication Data

US 2006/0102339 A1 May 18, 2006

(30) Foreign Application Priority Data

| | | |
|---|---|---|
| Nov. 12, 2004 | (CA) | 2487533 |
| Dec. 2, 2004 | (CA) | 2488794 |
| Apr. 4, 2005 | (CA) | 2503790 |

(51) Int. Cl.
*E21B 33/126* (2006.01)

(52) U.S. Cl. ..... 166/202

(58) Field of Classification Search ..... 166/387, 166/242.6, 242.1, 243, 202, 121, 196
See application file for complete search history.

(56) References Cited

U.S. PATENT DOCUMENTS

| | | | | |
|---|---|---|---|---|
| 1,262,107 | A * | 4/1918 | Sheasley | 166/189 |
| 3,823,788 | A | 7/1974 | Garrison et al. | |
| 3,830,304 | A | 8/1974 | Cummins | |
| 4,005,879 | A | 2/1977 | Berger | |
| 4,023,814 | A | 5/1977 | Pitts | |
| 4,111,261 | A | 9/1978 | Oliver | |
| 4,791,992 | A * | 12/1988 | Greenlee et al. | 166/387 |
| 5,060,723 | A | 10/1991 | Sutherland | |
| 5,261,487 | A | 11/1993 | McLeod | |
| 5,311,938 | A * | 5/1994 | Hendrickson et al. | 166/134 |
| 6,840,328 | B2 | 1/2005 | McKee | |
| 6,918,441 | B2 | 7/2005 | Dallas | |

(Continued)

FOREIGN PATENT DOCUMENTS

| | | |
|---|---|---|
| CA | 1169766 | 6/1984 |

(Continued)

OTHER PUBLICATIONS

Arrowhead Continental, "Arrowhead Tree Saver", Bulletin 153, 1986.

*Primary Examiner*—Jennifer H Gay
*Assistant Examiner*—David Andrews
(74) *Attorney, Agent, or Firm*—Sean W. Goodwin

(57) ABSTRACT

A packoff nipple for sealing an annular space in a well pipe has a tubular body, a sealing assembly positioned around the tubular body capable of axial movement along the tubular body and a stop to restrain the sealing assembly from extruding in-to the annular space. The sealing assembly includes one or more elastomeric sealing rings having a circumferential groove formed in a downhole face. An axially moveable actuator, such as a packer cup, engages the sealing ring assembly to causes at least a portion of the sealing rings to expand radially outwardly to seal the annular space and cause the sealing ring assembly to contact the uphole stop. The sealing rings are axially compressed between the uphole stop and the actuator to further expand the sealing rings. The uphole stop may be concave to urge the sealing rings away from the well pipe to avoid extrusion or permanent deformation.

17 Claims, 16 Drawing Sheets

U.S. PATENT DOCUMENTS

2002/0174988 A1* 11/2002 Szarka ..... 166/325
2006/0243457 A1* 11/2006 Kossa et al. ..... 166/387

FOREIGN PATENT DOCUMENTS

CA 1292676 12/1991
CA 2232890 5/2002
CA 2406011 3/2004

* cited by examiner

PACKOFF NIPPLE

FIELD OF THE INVENTION

The invention relates to a packoff nipple and structures supporting packoff nipples and more particular to a non-extruding packoff nipple and arrangement thereof for sealing an annular space in a well pipe.

BACKGROUND OF THE INVENTION

It is often the case that wells require stimulation to restart or enhance hydrocarbon flow. Such stimulation typically involves pumping stimulation fluid into the hydrocarbon bearing formation under pressure. Stimulation fluid may comprise components such as acid, sand, and energized carbon dioxide and nitrogen gases that, alone and under high pressures, can be damaging to the structural integrity and internal surfaces of a wellhead assembly that is installed at the top of a well casing or tubing. In other instances, it is preferred to localize the effects of elevated pressure in a well.

To protect a wellhead from damage including from high pressures and corrosive or erosive materials used during stimulation of a well, a wellhead isolation tool is used. Such a wellhead isolation tool typically includes a tubular mandrel inserted through the wellhead, blow out preventors (BOP) and the like and into the well tubing or casing therein, such that pressurized stimulation fluids pass through the mandrel without exposure to the wellhead and surface equipment components. To completely seal the wellhead from stimulation fluids during operation, the mandrel has a sealing means, commonly referred to as a sealing nipple or packoff nipple, at its downhole end for achieving a fluid seal against the inside of the tubing or casing while under high stimulating pressure. Such packoff nipples are very well known in the art. For example, U.S. Pat. No. 4,023,814 to Pitts, U.S. Pat. No. 4,111,261 to Oliver, 1978, Canadian Patent 1,169,766 to McLeod and U.S. Pat. No. 5,060,723 to Sutherland and Wenger disclose an annular elastomeric sealing cup attached in a fixed position to a nipple body which expands radially under high fluid pressures to form a friction seal of the annular space between the nipple body and the well tubing or casing. Oliver further discloses an elastomeric packer ring fixedly positioned above the sealing cup as a secondary sealing means. More recently, axially moveable annular elastomeric sealing members have been disclosed whereby stimulation pressures force an elastomeric member to move upwardly and extrude into a narrowing annular space, thereby resulting in an extrusion seal. For example, in U.S. Pat. No. 5,261,487 to McLeod and Roesch, a lower sealing cup expands radially and moves upwardly against an upper packer ring. The packer ring is then forced to extrude between a shoulder section projecting outwardly from the nipple body and the well casing or tubing. In U.S. Pat. No. 6,918,441 to Dallas, rather than using packer ring, a top portion of a sealing cup is extruded. In both cases, however, both a friction seal and an extrusion seal are formed. When pressure is equalized and the nipple is withdrawn from the tubing, the elastomeric members are anticipated to collapse to their original shape thereby allowing safe extraction of the wellhead isolation tool.

To remove the packoff nipple after well stimulation operations are completed, the residual well pressure is equalized above the packoff nipple in the objective of relaxing the elastomeric seals to thereby allow for safe extraction of the packoff nipple.

In general, elastomeric seals of prior art packoff nipples are susceptible to damage during well tubing or casing entry or exit, particularly when the packoff nipple must pass areas of restricted internal diameter. This can be particularly problematic with extruded seals, which typically become permanently deformed when actuated. Prior art packoff nipples are also prone to seal pre-activation during well tubing entry whereby the seals are forced from their protective running-in condition to an actuated condition, thereby increasing the likelihood of seal damage. In any case, damage to the seals does not permit the packoff nipple to be reused and also results in damaged seal material being left in the well, thereby increasing the cost of operations.

Other difficulties encountered by prior art packoff nipples include seal failure due to seal damage by exposure to extreme temperatures associated with $CO_2$ and $N_2$ stimulating fluids, as well as due to misalignment of the packoff nipple in the well tubing.

There is, therefore, a need for an improved packoff nipple.

SUMMARY OF THE INVENTION

The invention provides an improved packoff nipple that provides a non-extruding sealing means for sealing an annular space in a well pipe, such as in response to differential pressures across the packoff nipple. Herein, one embodiment of the packoff nipple is described in the context of isolating high pressures downhole of the packoff nipple and orienting terms of downhole and uphole are used and understood to apply in that context, although other orientations are possible and the term downhole would then also refer to the higher pressure side of the packoff nipple.

In one embodiment, the packoff nipple provides one or more elastomeric sealing rings adapted to seal the annular space in response to an actuating mechanical force, preferably pressure-induced, exerted against each sealing ring. Furthermore, the packoff nipple is adapted to axially compress the sealing rings in response to increasing pressure. Upon equalization of the pressure differential across the packoff nipple, the sealing rings substantially return to their pre-actuated shape, thereby permitting the packoff nipple to be safely extracted from the well pipe without incurring damage to the sealing rings. The packoff nipple can be used for any operations that introduce elevated pressure into a well where it is desired to isolate the annular space. For example, one or more packoff nipples can be fit on the end of a mandrel of a wellhead isolation tool to isolate an uphole wellhead from high pressures and corrosive materials used downhole of the packoff nipples during well stimulation.

In further detail, an embodiment of the packoff nipple comprises a tubular body adapted to be positioned within a bore of a well pipe, with an annular space being formed between the tubular body and the well pipe. A sealing ring assembly comprising at least one elastomeric sealing ring is positioned to be axially moveable around the tubular body. Each sealing ring includes a downhole face having a circumferential groove formed therein and an expansion portion adjacent the circumferential groove. The packoff nipple further comprises an uphole stop positioned around the tubular body and uphole of the sealing ring assembly to substantially extend across the annular space, and an actuator positioned axially moveably around the tubular body and downhole of the sealing ring assembly. In operation, the actuator is caused to move uphole, such as by elevated pressure in the annular space below the actuator, and forcibly engage the sealing ring assembly. Mechanical force is therefore applied against or transferred to the downhole face of each sealing ring causing at least the expansion portion of each sealing ring to expand radially to seal the annular space and the sealing ring assembly to move uphole until it contacts the uphole stop. Upon contact with the uphole stop, the sealing ring or rings are axially compressed between the actuator causing further radial expansion of the sealing rings to further accentuate the sealing of the annular space. Notably, the sealing rings adjacent the uphole stop are encouraged not to extrude past the uphole stop or otherwise become permanently destroyed when actuated, thereby allowing the packoff nipple to be used repeatedly in the same or other operations in a cost-effective manner.

The sealing ring assembly preferably includes a plurality of stacked sealing rings to provide a redundancy in sealing. The sealing ring assembly can further include rigid spacers positioned between the actuator and an adjacent sealing ring and between adjacent sealing rings. The rigid spacers may assist in keeping the sealing rings perpendicular to the tubular body for tripping in and out of the well pipe and in equalizing actuating forces exerted across the downhole face of a sealing ring.

Preferably, the actuator is an elastomeric packer cup positioned downhole of the sealing ring assembly and being moveable on the tubular body, in which case the packer cup provides a primary seal, with the sealing ring assembly providing a secondary seal.

The sealing rings and the packer cup of the packoff nipple can also be adapted in various ways to avoid pre-activation, whereby the sealing rings and packer cup are forced from their protective running-in condition to an actuated condition and consequently damaged or destroyed as they enter the restrictive annular space.

Further adaptations to the packoff nipple that provide functional and structural advantages for any packoff nipple are also described. For example, the uphole stop can have a concave stop surface that urges or constrains a top of an adjacent sealing ring or any other suitable sealing member radially inwardly to avoid extrusion. In addition, an improved sleeve suitable for use with any sealing member, such as a packer cup, intended to be slidably fit around a tubular body is also provided, whereby the sleeve includes an upper radial compression surface to form a supplemental seal between the radial compression surface and the tubular body.

BRIEF DESCRIPTION OF THE DRAWINGS

In drawings which are intended to illustrate embodiments of the invention and which are not intended to limit the scope of the invention.

DESCRIPTION OF THE INVENTION

Figure 1A:
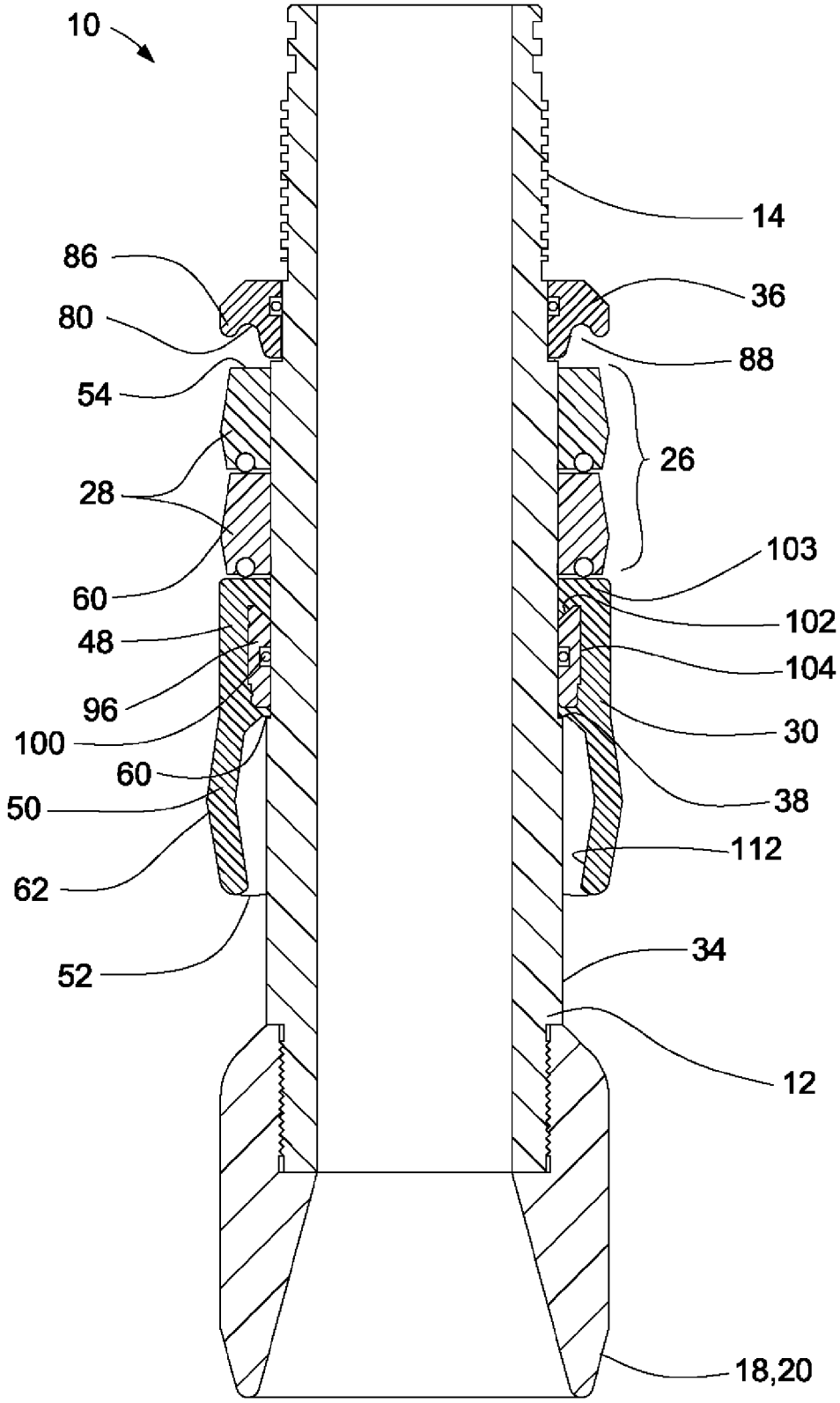
FIG. 1A is a cross-sectional view of one embodiment of a packoff nipple of the present invention.

With reference to FIGS. 1A-1C, 2A and 2B, embodiments of a packoff nipple 10 are shown generally comprising a tubular body 12 having a threaded uphole end 14 connected to a threaded downhole end of a mandrel 16. A downhole end 18 of the packoff nipple 10 terminates in a bullnose 20 for guiding and centralizing the packoff nipple 10 into the bore 11 of a well tubing or casing, referred to herein as well pipe 22. An annular sealing space 24 is formed between the tubular body 12 and the well pipe 22. Positioned above the bullnose 20 is an upper sealing ring assembly 26 comprising at least one elastomeric sealing ring 28 and sandwiched between a lower actuator or elastomeric packer cup 30 and an uphole annular stop 36 for actuating the sealing ring or rings 28. Optionally, the sealing ring assembly 26 can include rigid spacers 32 positioned between the packer cup 30 and an adjacent sealing ring 28 and between adjacent sealing rings 28. Each of the sealing ring assembly 26 and packer cup 30 is adapted to be fit or positioned around an outer circumference 34 of the tubular body 12 to extend outwardly into the annular sealing space 24 and to move axially uphole and downhole along the tubular body 12. The invention may further comprise a downhole stop 38 for limiting downhole axial movement of the sealing ring assembly 26 and the packer cup 30.

In principle, elevated fluid pressures in the annular sealing space 24 downhole of the packoff nipple 10, such as from well stimulation operations, cause the packer cup 30 to actuate and move axially along the tubular body then to engage and actuate the sealing ring assembly 26, thereby reversibly sealing the annular sealing space 24 with the packer cup 30 and each sealing ring 28.

In detail and with further reference to FIGS. 3 and 4A-C, each sealing ring 28 has a pressure-facing downhole face 40 with at least one circumferential groove 42 formed intermediate the face. Adjacent the circumferential groove 42 is a lower expansion portion 44 of the sealing ring 28. Optionally, an O-ring is mounted within the circumferential groove to enhance the expansion of the lower expansion portion 44. Preferably, the O-ring 45 is made of a material having a higher durometer than the sealing ring 28 and may protrude from the circumferential groove in a non-actuated situation.

While the packoff nipple 10 can include a single sealing ring 28, it may be desired to use a stack of two or more sealing rings 28 to provide a redundancy in sealing.

Figures 4A, 4B, 4C:
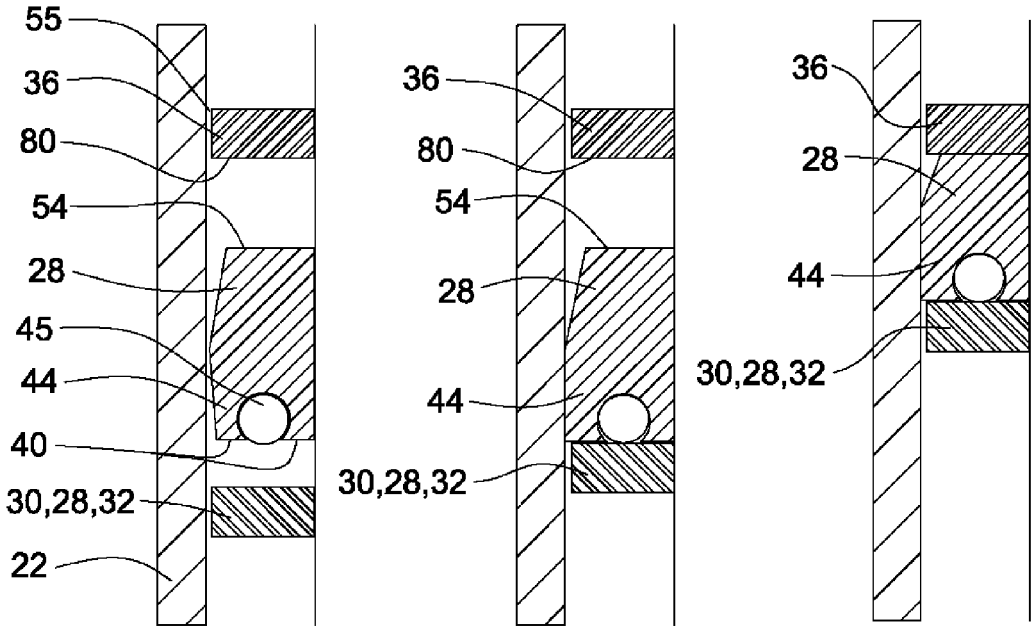
FIGS. 4A, 4B and 4C are sequential views of a partial cross-section of a sealing ring according to an embodiment of the invention, with the sealing ring installed in a well pipe and illustrated in a non-actuated condition (FIG. 4A), one possible actuated condition (FIG. 4B), and a further actuated condition with a top of the sealing ring in contact with an uphole stop (FIG. 4C)

The packer cup 30 comprises an elongated elastomeric member having a mounting portion 48 and a downwardly depending skirt 50 that is open at its bottom end 52. In operation, upon elevated pressure, the skirt 50 flares, i.e. expands outwardly, to seal against the well pipe 22 thereby providing a primary seal. The pressure contained in the skirt 50 then causes the packer cup 30 to slide axially on the tubular body 12 towards low pressure and forcibly engage the sealing ring assembly 26. The resulting mechanical force exerted on the downhole face 40 of each sealing ring 28, either by forcible contact of the packer cup 30, a top 54 of another sealing ring 28, or rigid spacer 32, causes the lower expansion portion 44 to expand radially to seal the annular sealing space 24 (FIG. 4B). The sealing ring or rings 28 thus provide a secondary seal. Further yet, as stimulation pressure increases, the sealing ring assembly 26 slides up the tubular body 12 until the top of the sealing ring assembly 26, typically a top 54 of an uppermost sealing ring 28, contacts the uphole stop 36 (FIG. 4C). The uphole stop 36 thereby arrests movement of the sealing ring assembly 26, causing the one or more sealing rings 28 to compact or compress axially and further expand radially, outwardly and inwardly, between the tubular body 12 and the well pipe 22. This compression may assist in keeping the downhole face 40 of each sealing ring 28 facing downward against the high fluid pressure to further strengthen the sealing action. Notably, after extraction of the packoff nipple, there is no evidence that any sealing rings 28 are extruded into an annular space 55 adjacent the uphole stop 36 and the well pipe 22.

To release the packoff nipple 10 from its actuated condition, stimulation pressure is removed and equalizing pressure corresponding to the residual well pressure is applied above the packoff nipple 10. The equalizing pressure migrates downwardly past the sealing rings 28, and further migrates to the packer cup 30 to thereby release the packer cup 30 from the tubular body 12. If necessary, the packoff nipple 10 can be stroked up and down to encourage the equalizing pressure to migrate past any sealing rings 28 and the packer cup 30. Since the sealing rings 28 and packer cup 30 are not extruded or otherwise permanently deformed, they substantially instantaneously and reversibly return to their pre-activated state when the packoff nipple 10 is released from its actuated condition. Consequently, the packoff nipple 10 can be used repeatedly in the same or other operations.

To restrict downward slippage of the packer cup 30 during extraction of the packoff nipple 10 from the well pipe, the downhole stop 38, provides an outwardly projecting shoulder formed from the tubular body 12 against which a bottom surface 60 of the mounting portion 48 of the packer cup 30 can abut. The downhole stop 38 should be positioned sufficiently far from the bullnose 20 to prevent the skirt 50 of the packer cup 30 from lodging between the well pipe 22 and the bullnose 20 as the skirt 50 becomes elongated when the packoff nipple 10 is extracted.

While it is preferred that the sealing ring assembly 26 be moveably positioned around the tubular body 12 to reduce the likelihood of pre-activation of sealing rings 28 upon entry into restricted areas of the well pipe 22, the sealing ring assembly 26 can also be adapted to resist upward axial movement. For example, the sealing ring assembly 26 can frictionally engage the tubular body or be positioned to abut against the uphole stop 36 when in the non-actuated position.

The sealing rings 28 and packer cup 30 can be of any suitable fabrication and construction as would be apparent to one skilled in the art. For example, the elastomeric material can be any suitable urethane. Preferably, the sealing rings 28 are made of a material having a durometer value in the order of about 80 A-95 A, and most preferably 95 A, whereby the material is soft enough to be expandable under typical operating conditions, while being hard enough to not be undesirably deformed. Generally, the packer cup 30 is made of softer material than the sealing rings 28. Further preferably, elastomeric material is resistant to degradation by intense pressure, chemical and extreme hot or cold temperatures conditions encountered in well stimulation operations, such as the proprietary "hybrid" urethane provided by HiTek Urethane Ltd (Nisku, Alberta). Applicant has noted that while stimulation operations intend that stimulation fluids be pumped at temperatures of about 80-100° F., temperatures often have exceeded 200° F. Consequently, conventional urethane sealing rings, which tend to break down at temperatures exceeding 180° F., may be unsuitable in some cases. The urethane should also be manufactured under known standards and conditions with respect to cleanliness and curing temperatures and times that are important for maintaining the strength of the urethane, such as those for 95 A urethane. Further, the urethane may also be manufactured with an integrated lubricant additive to reduced the chance of pre-activation of the sealing rings 28 and packer cup 30.

To reduce the likelihood of pre-activation and damage to the sealing ring 28 upon entering restricted well pipe diameter, an outer diameter 62 of the sealing ring 28 can be marginally less than an outer diameter 64 of the packer cup 30.

Figure 3:
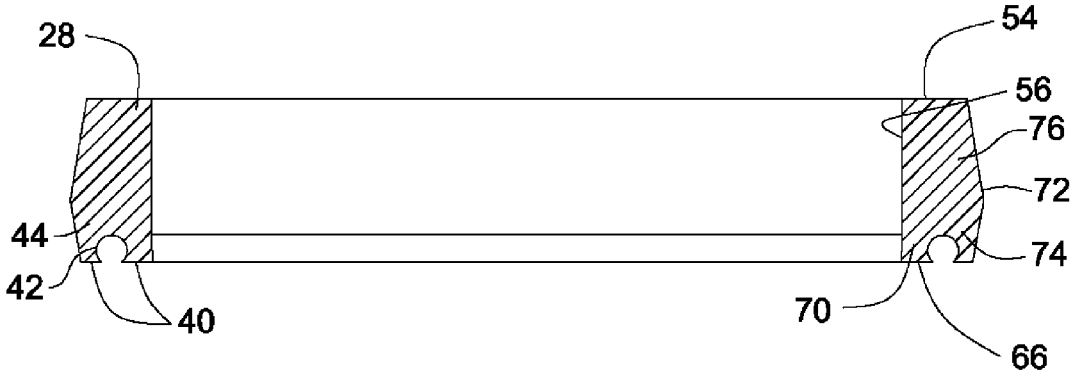
FIG. 3 is a cross sectional view of a sealing ring of a packoff nipple according to an embodiment of the present invention.

As is particularly shown in FIG. 3, a bottom end 66 of each sealing ring 28 can have a smaller inner diameter than the top end 54 of the sealing ring 28, such that the bottom end 66 has a radially inwardly directed bottom lip 70. This construction effectively provides a one-way seal which seals in response to well stimulation pressure, and provides a less effective seal in response and in favor of equalizing pressure. In particular, upwardly directed force applied to the downhole face 40 of the sealing ring 28 during well stimulation drives the bottom lip 70 into tighter, slidable contact with the tubular body 12. Conversely, downwardly directed equalizing pressure is permitted to migrate past the sealing ring, such as along the inner sidewall 56, with the equalizing pressure forcing the bottom lip 66 away from the tubular body 12.

Preferably, an outer sidewall 72 of each sealing ring 28 has a generally V-shaped, radially outwardly tapered profile, with a lower portion 74 of sealing ring 28 being tapered upwardly and radially outwardly to an apex and an upper portion 76 of the sealing ring 28 being tapered upwardly and radially inwardly from the apex. The V-shaped profile assists in actuation of the sealing rings 28. In particular, as the apex of the actuated sealing ring 28 is axially compacted between the packer cup 30 and the uphole stop 36, compressive forces cause a reactive expansion of the lower portion 74. The V-shaped profile also assists in minimizing damage to any sealing rings 28 upon entry into the well pipe 22 by reducing the outer cross-sectional diameter of the downhole face 40 of the sealing rings 28 and permitting the sealing rings 28 to compress radially inwardly when entering restricted well diameters.

Figure 5:
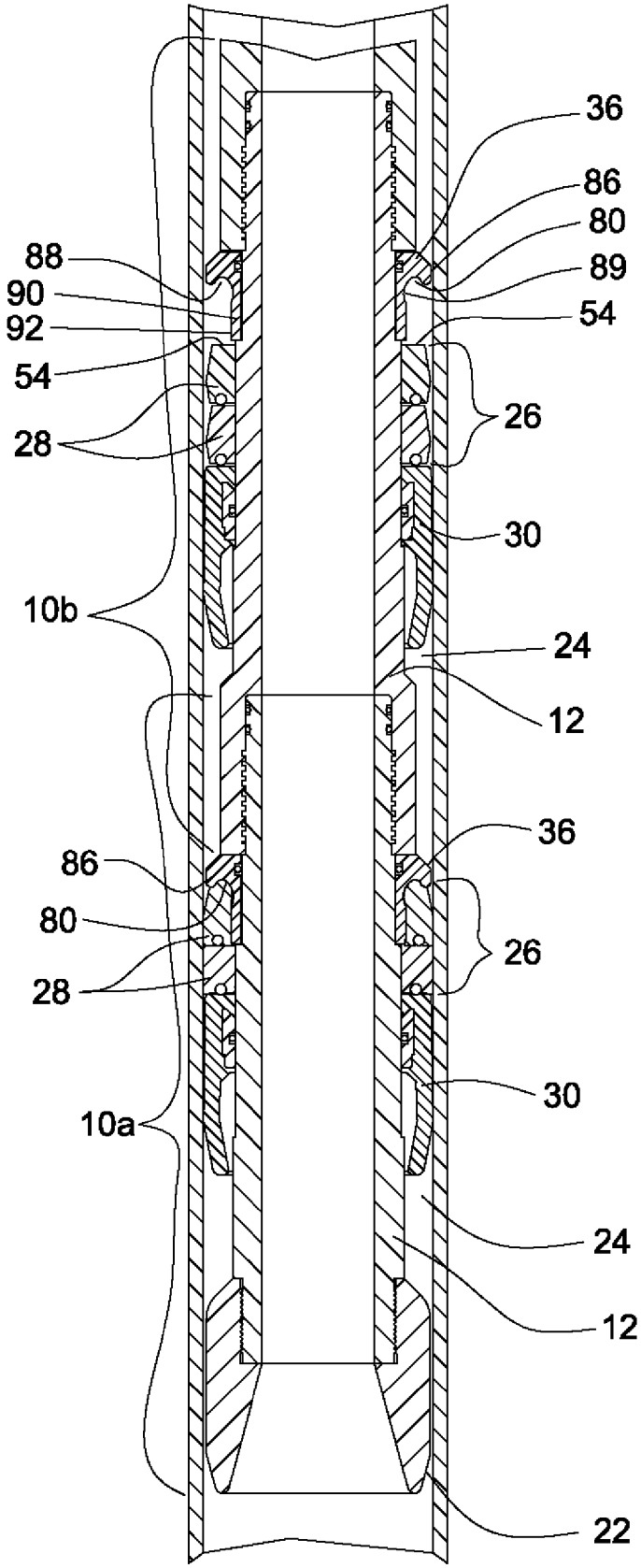
FIG. 5 is a cross-sectional view of an arrangement of a pair of packoff nipples according to yet another embodiment of the present invention, with a lower packoff nipple in an actuated condition and an upper packoff nipple in a non-actuated condition.
Figure 6A:
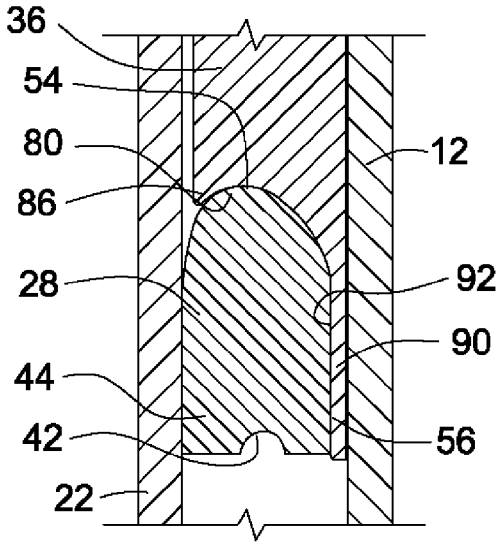
FIGS. 6A, 6B and 6C are cross-sectional views of an uphole stop of a packoff nipple according to other embodiments of the present invention, with the uphole stop positioned in a well pipe and a sealing ring engaged with the uphole stop.
Figure 6B:
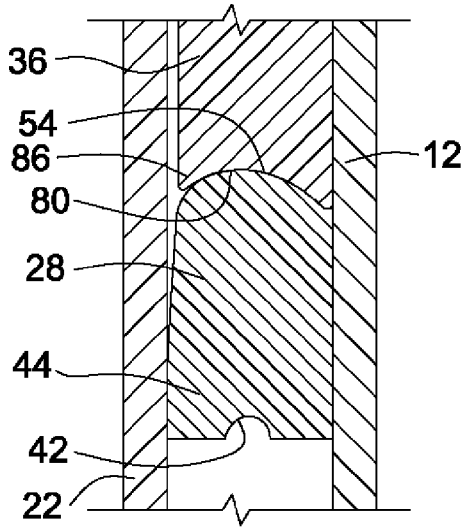
Figure 6C:
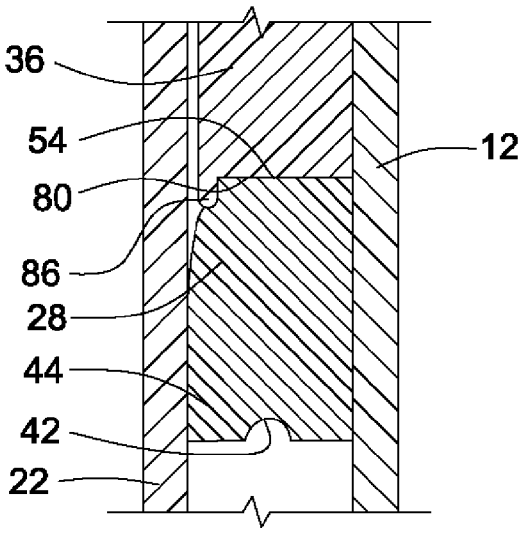

Referring now to FIG. 5, while the packoff nipple 10 has thus far been described as being a single packoff nipple 10, the packoff nipple 10 can also be a plurality of packoff nipples 10*a*, 10*b*, etc. Each of a first and second, or lower and upper, packoff nipple 10*a*, 10*b* can be provided as a separate tubular body 12 with the tubular bodies 12 in coaxial connection, or the packoff nipples 10 can be integrally formed on a single tubular body 12. In the embodiment shown in FIG. 5, the packoff nipple 10 comprises a lower packoff nipple 10*a* and upper packoff nipple 10*b*, with each of the lower and upper packoff nipples 10*a*, 10*b* having a sealing ring assembly 26, a packer cup 30 and an uphole stop 36. The lower packoff nipple 10*a* serves as a primary packoff nipple, and also assists in centralizing the packoff nipple 10 in well pipe 22. Consequently, the upper packoff nipple 10*b* is less susceptible to damage than the lower packoff nipple 10*a* and thereby serves as a secondary or backup packoff nipple should the lower packoff nipple 10*a* fail. Further, in some instances, it may be desired to size the upper packoff nipple 10*b* to closer tolerances than the lower packoff nipple 10*a*.

Figure 7:
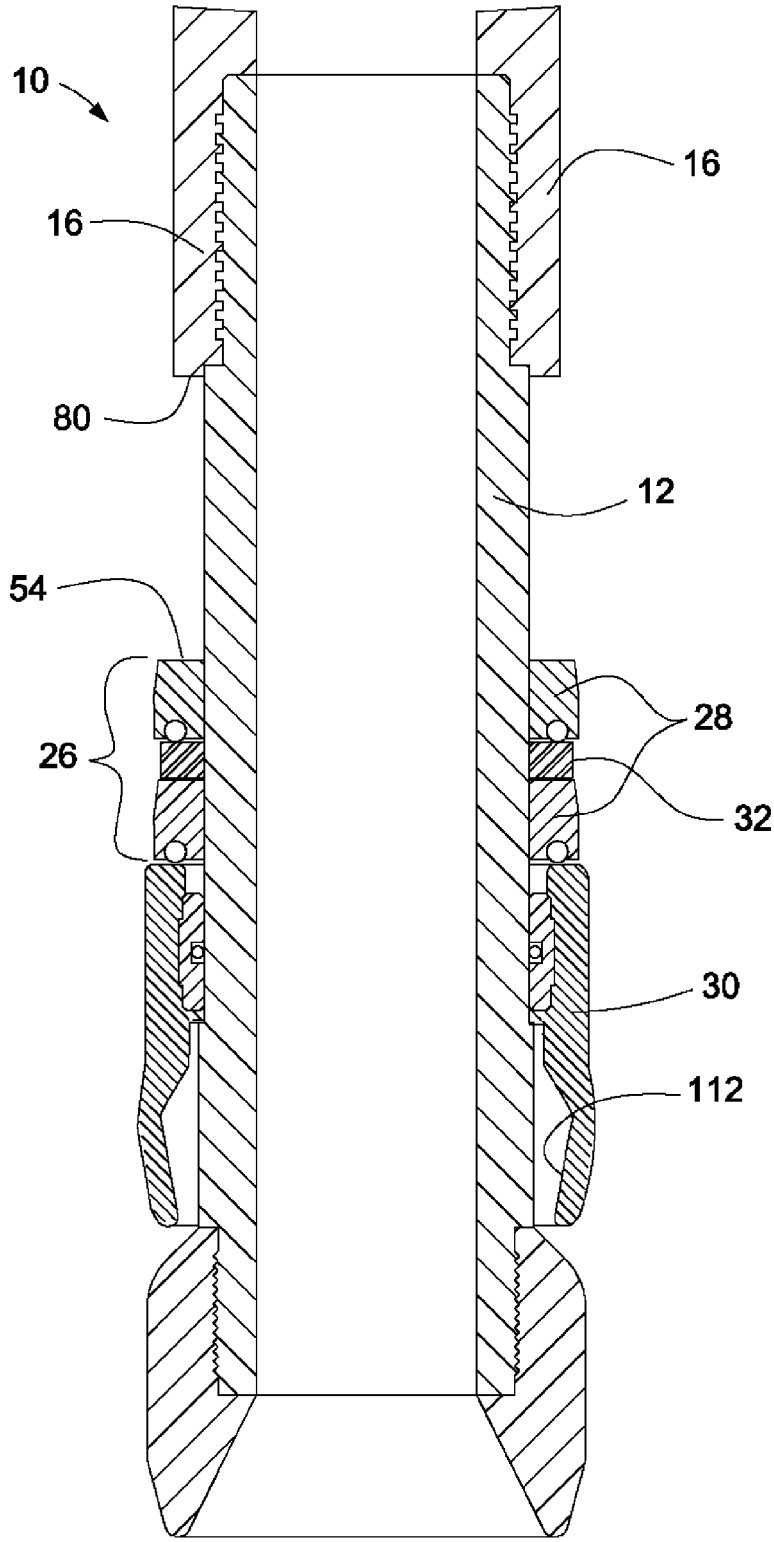
FIGS. 7, 8, 9, and 10 are cross-sectional views of a packoff nipple according to yet other embodiments of the present invention, with the packoff nipple in a non-actuated condition.
Figure 12:
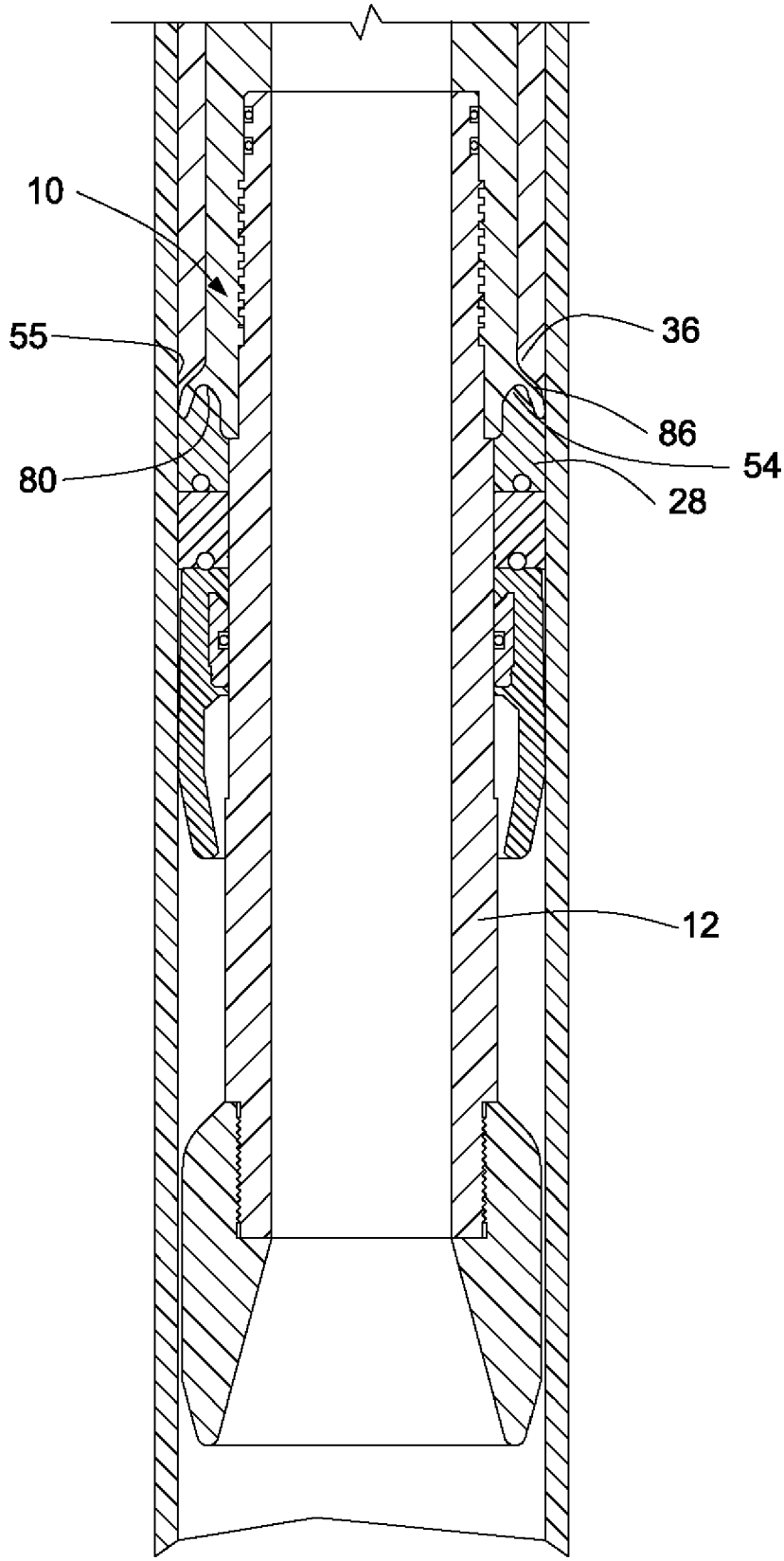
FIG. 12 is a cross-sectional view of yet another embodiment of a packoff nipple according to the present invention, having an integrated concave uphole stop.

With additional reference to FIGS. 6A-C and 7-10, the uphole stop 36 is generally positioned around the tubular body 12 and includes an annular stop surface 80 extending substantially across the annulus 24 against which a top 54 of an adjacent sealing ring 28 can abut or contact. The uphole stop 36 may be formed, for example, from a sizing ring positioned around the tubular body 12 (FIGS. 1A-C, 2A, 2B, 5, 8-10) or from the lower box end of the mandrel 16 (FIGS. 7, 12). In any case, the uphole stop 36 is sized to minimize the annular space 55 between the uphole stop 36 and the well pipe 22 to aid in avoiding extrusion of the sealing ring 28 therebetween. The stop and the sealing ring 28 cooperate to avoid extrusion. Further, such sizing can also aid in centralizing the packoff nipple 10 within the well pipe 22.

With particular reference to FIGS. 1A-C, 2A, 2B, 5 and 6A-C and 12, the uphole stop 36 preferably forms a downwardly depending lip 86 spaced radially and outwardly from the tubular body 12 for constraining the top 54 of the adjacent sealing ring 28 radially inward to the tubular body 12. The lip 86 thereby helps to ensure the adjacent sealing ring 28 does not extrude into the annular space 55 uphole of the stop 28.

The annular surface 80 of the uphole stop 36 may be flat, as shown in FIGS. 5C, and 6-9. Preferably, and as shown in FIGS. 1A-C, 2A, 2B, 5 and 6A-B, and 12, the annular surface 80 of the uphole stop 36 forms a concave shape defining an annular cup space 88 into which the top 54 of an adjacent sealing ring 28 will form-fit. When actuated into the uphole stop 36, the top 54 of the sealing ring 28 is forced to engage the increased surface area provided by the concave annular surface 80. Consequently, the sealing ring 28 is drawn radially inwardly into the annular cup space 88 and concomitantly away from the well pipe 22, thereby avoiding extrusion of the sealing ring 28 past the uphole stop 36. Further, applicant has further observed that it appears the concave shape can result in the formation of a vacuum between the annular surface 80 and the immediately adjacent sealing ring 28 upon increased stimulation pressure and assisting in retaining the sealing ring 28 therein. Consequently, the adjacent sealing ring 28 is securely fit within the concave uphole stop 36, even after stimulation pressure is equalized, which may reduce the risk of damage to the sealing ring 28 when the packoff nipple 10 passes restricted diameters as it is withdrawn from the well pipe 22.

To assist in the entry of the sealing ring 28 into the annular cup space 88, the stop surface 80 may have an extended radially inwardly profiled portion 89, as seen in FIG. 5. Further, a top 54 of the sealing ring can be sized to extend no farther into the annular sealing space 24 and the lip 86 of the uphole stop 36 can have a rounded edge 130.

Figure 13:
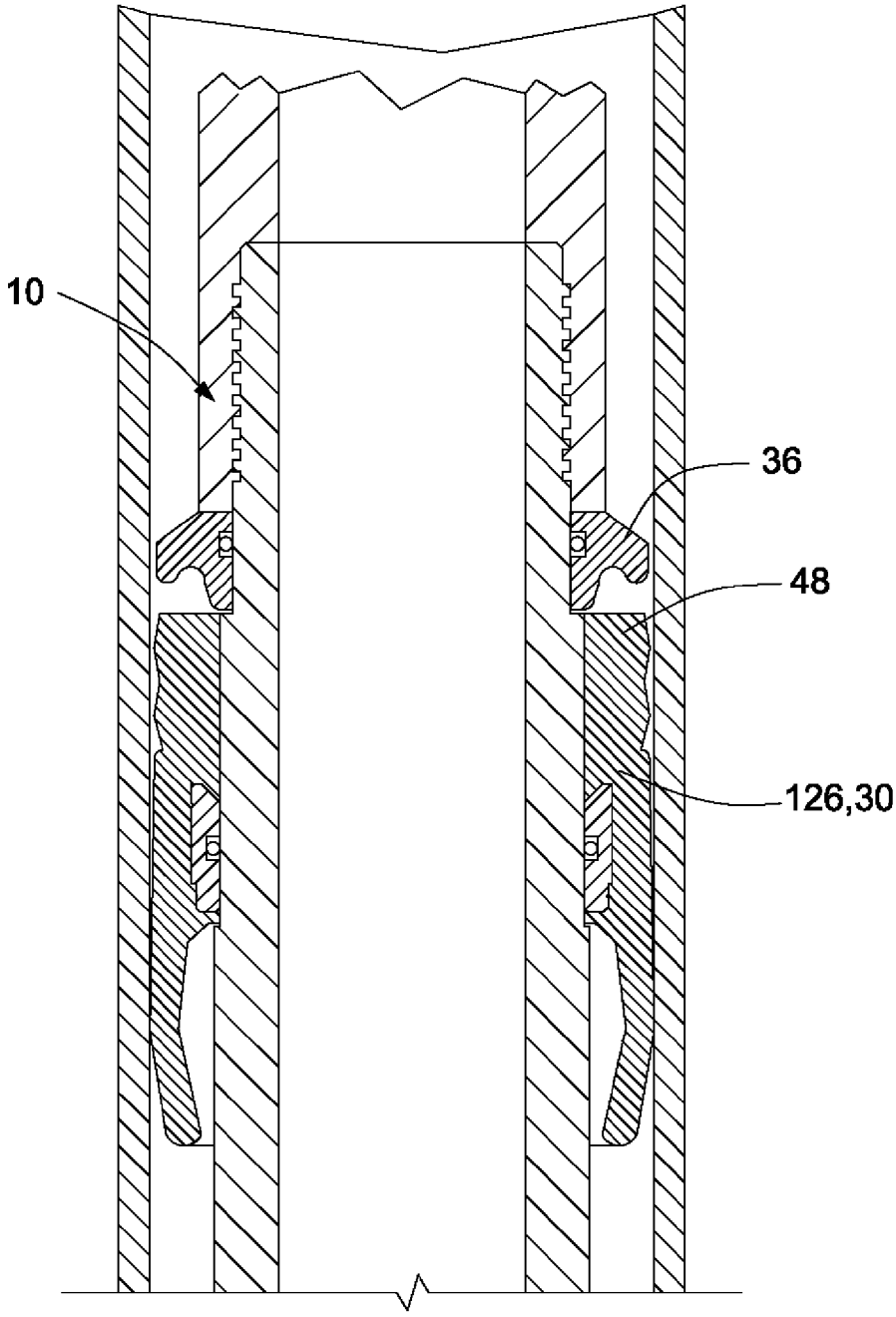
FIG. 13 is a cross-sectional view of still yet another embodiment of a packoff nipple according to the present invention, with no sealing rings and an elongated packer cup.

With additional reference to FIG. 13, while is particularly contemplated that the concave uphole stop 36 be used with a sealing ring 28, the concave uphole stop 36 can be used with any suitable elastomeric sealing member 126. For example, as shown, the concave uphole stop 36 can be used with a packer cup 30 having an elongated mounting portion 48.

With particular reference to FIGS. 2A, 2B, 5, 6A, and 8-10, the packoff nipple 10 can also include a radial sizing or expansion ring 90 securely positioned around the tubular body 12 for further expanding an uppermost sealing ring 28. In general, the expansion ring 90 is positioned between the sealing ring assembly 26 and the uphole stop 36. The axial extent of the expansion ring 90 generally corresponds to at least the height of one sealing ring 28 and the transverse cross-sectional diameter of the expansion ring 90 is sized to permit an inner diameter of the sealing ring 28 to slidably move over the expansion ring 90 under elevated pressures. Substantially the whole axial extent of the inner side wall 56 of the sealing ring 28 is thus forced over the expansion ring 90 and the sealing ring 28 is further reversibly expanded radially outward into the annular sealing space 24 formed between the expansion ring 90 and the well pipe 22. Simply, the inner diameter of the sealing ring 28 is expanded over the expansion ring 90, thus improving its sealing capability. Further, the mechanical effect of the expansion ring 90 reduces the fluid pressures required for the sealing ring 28 to create an effective seal, thereby helping to ensure that a seal is made early in the stimulation process.

In the embodiments shown, the expansion ring 90 is integrally formed with the uphole stop 36, although the expansion ring 90 can be separate from the uphole stop 36.

In an arrangement of lower and upper packoff nipple 10*a*, 10*b*, as shown in FIG. 5, it is preferable that the lower packoff nipple 10*a* is not fit with an expansion ring 90 so as to minimize pre-activation of the sealing rings 28 during entry into the well pipe 22. Since the sealing rings 28 of the upper packoff nipple 10*b* are less likely to be pre-activated, it is preferable that the upper packoff nipple 10*b* be fit with an expansion ring 90 to provide a more effective seal during well stimulation.

Figure 8:
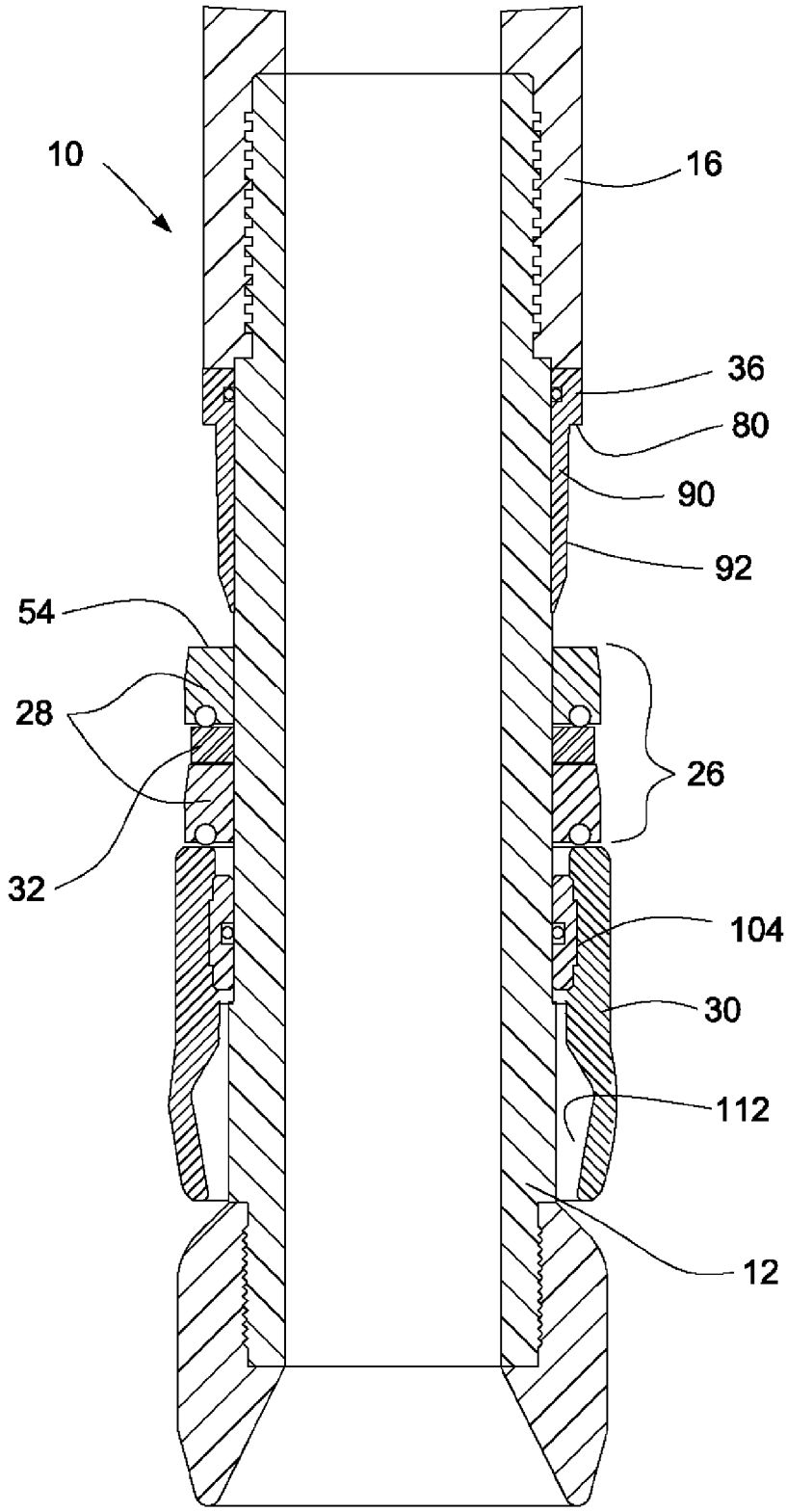
Figure 9:
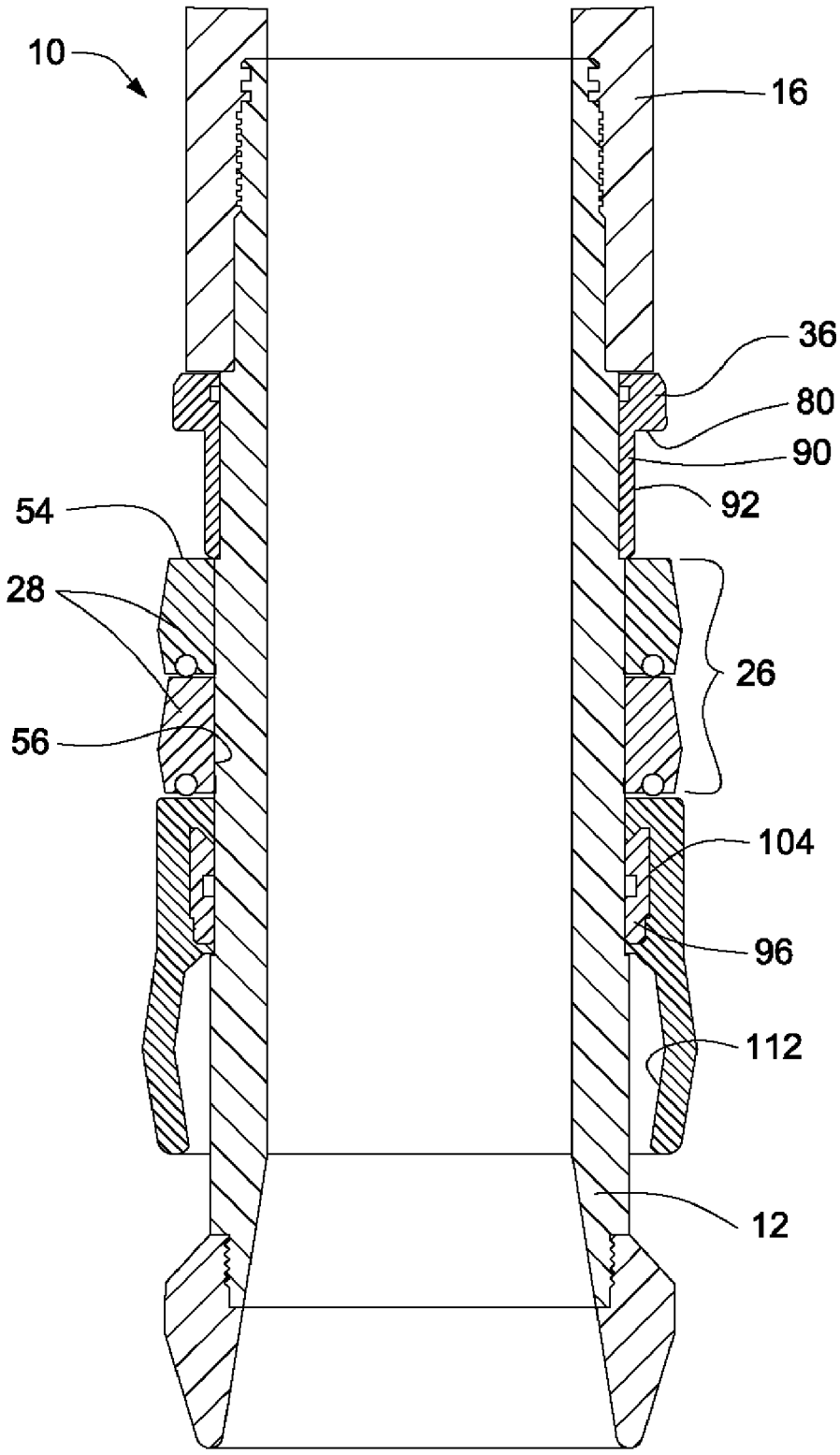
Figure 10:
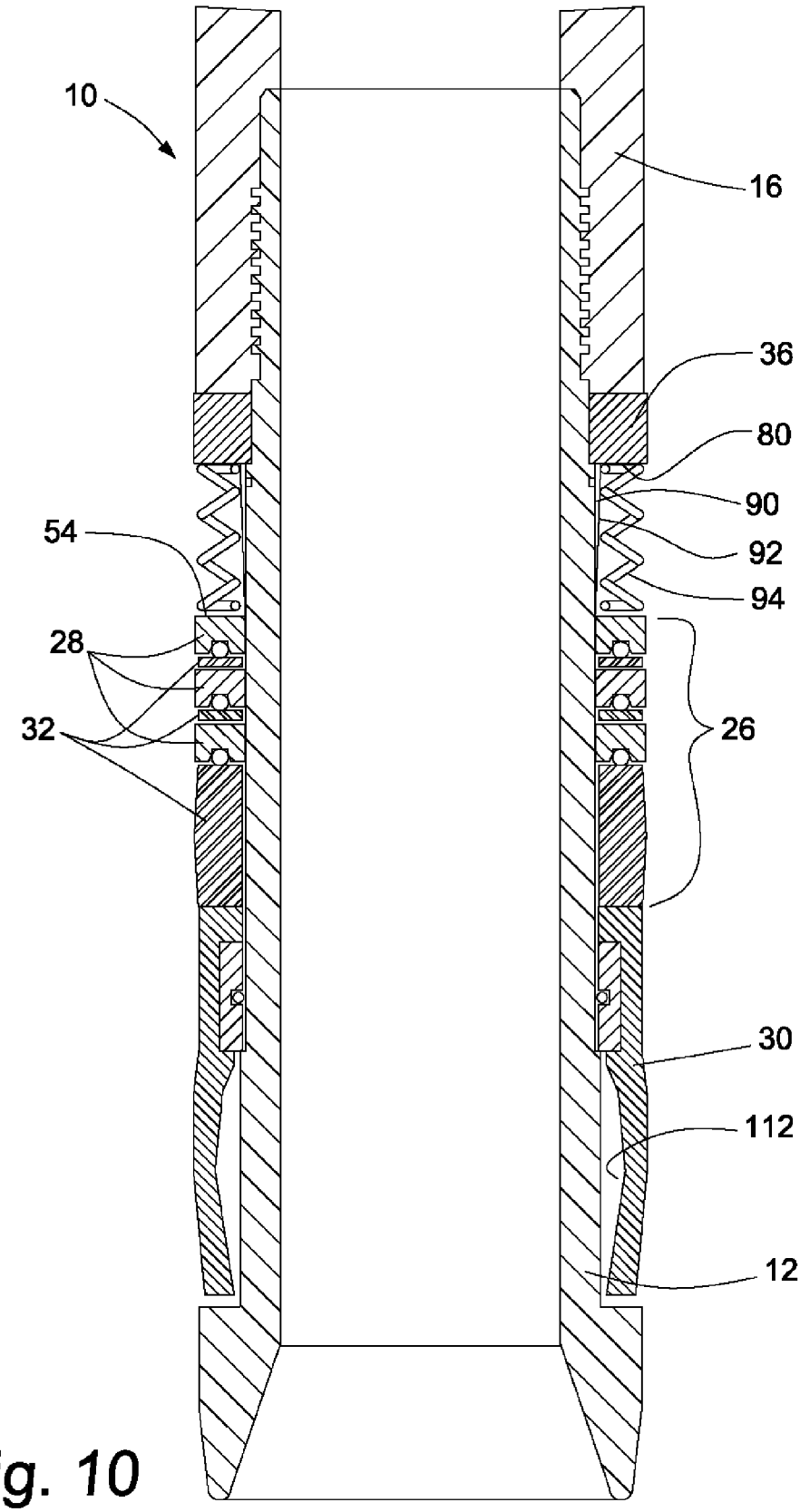

The outer sidewall 92 of the expansion ring 90 can be parallel to the tubular body 12, (FIGS. 2A, 2B, 5, 9), or can form an upwardly and radially outwardly tapering surface to increase the seal with increasing stimulation pressure (FIGS. 8, 10). As shown in FIG. 10, a spring 94 may also be positioned to extend downwardly from the annular stop surface 80 to urge the sealing ring assembly 26 off the expansion ring 90 after pressure has been reduced.

Where the outer sidewall 72 of the sealing ring 28 has a V-shaped profile, as described previously, the cross-sectional width of each of the expansion ring 90 and the top 54 of the sealing ring 28 are preferably sized to prevent substantial radial expansion of the top 54 of the sealing ring 28. At the same time, more significant compressive force is exerted on the upper portion 76 of the sealing ring, thereby directing the expansion portion 44 to expand radially and further improve the seal. In other words, the cross-sectional width of the annular surface of the stop 36 substantially corresponds to the cross-sectional width of the top 54 of the sealing ring 28.

Where rigid spacers 32 are used, as described previously, the rigid spacers 32 can be, for example, high durometer thrust washers, steel washers, or axially elongated steel rings. In general, the rigid spacers 32 assist in keep the sealing rings 28 generally perpendicular to the tubular body 12, which reduces the likelihood of seal pre-activation. Further, the rigid spacers 32 assist in equalizing force exerted across the downhole face 40 of the sealing ring 28. This may be particularly important if there has been damage to the downhole face 40 of the sealing ring 28. The spacers 32 may also help ensure that equalization pressure migrates to the packer cup 30.

Having now described various embodiments of the sealing assembly, the packer cup will now be described in detail. As previously described, the packer cup 30 comprises an elastomeric mounting portion 48 and a downwardly depending elastomeric skirt 50. The packer cup can also include further features, including a rigid sleeve 96 securely inset within the mounting portion 46 and adjacent the tubular body 12, and which is slidably positioned on the tubular body 12. Preferably, the sleeve 96 is made of steel and the mounting portion 48 is bonded to the sleeve 96. Typically, the sleeve 96 includes a groove 98 in its inner periphery into which an elastomeric O-ring 100 is mounted, thereby creating a moveable seal between the packer cup 30 and the tubular body 12. The O-ring 100 also helps to ensure that stimulation fluid does not leak between the tubular body 12 and the packer cup 30.

The sleeve 96 can be configured in a variety of ways to enhance operation of the packer cup 30. As shown, for example, in FIG. 1A, the sleeve can include an upper radial compression surface 102. As an upper portion of the packer cup 103 above the sleeve 96 is axially compressed upon forcible engagement with the sealing ring assembly 26, elastomeric material is compressed between the radial compression surface 102 and the tubular body 12, thereby providing an improved seal of the packer cup 30 upon extreme deformation. For example, the radial compression surface 102 provides a backup seal or catch should the bonding surface between the sleeve 96 and the mounting portion 48 fail. Such a situation may occur if the packoff nipple 10 is not adequately centralized in the well pipe 22, thereby permitting the mounting portion 48 at the larger side of the annulus to tear away from the sleeve as the packer cup is forced against the well pipe 22 when actuated. The seal formed by the radial compression surface 102, however, helps to ensure that fluid pressure does not escape past the packer cup 30. Further, the radial compression surface provides additional surface for bonding the mounting portion 48 to the sleeve 96.

While it is particularly contemplated to use a sleeve 96 having a radial compression surface 102 with the packer cup 30, such a sleeve could be used for any type of sealing member including a sleeve to be fit on any tubular body, such as some sealing rings.

In another embodiment, and with reference to FIGS. 1A, 1B, 7, and 8, a portion of the outer sidewall 104 of the sleeve 96 may be profiled. This increases the surface area and durability of the bond between the sleeve 96 and the mounting portion 48, particularly when subjected to high mechanical shear forces as the packoff nipple 10 enters or exits the well tubing. Furthermore, as the profiled sections accommodate increased thickness of the elastomeric material adjacent to the outer sidewall 104 of the sleeve 96, the mounting portion 48 is more likely to be axially compressed during activation of the packer cup 30 and thereby provide an additional point of sealing. Such compression also guards against failure of the bond between the mounting portion 48 and the sleeve 96.

With particular reference to FIG. 9, profiling can further comprise notches on the outer sidewall 104 of the sleeve 96 to further increase the durability of the bond between the sleeve 96 and the elastomeric member.

Figure 1B:
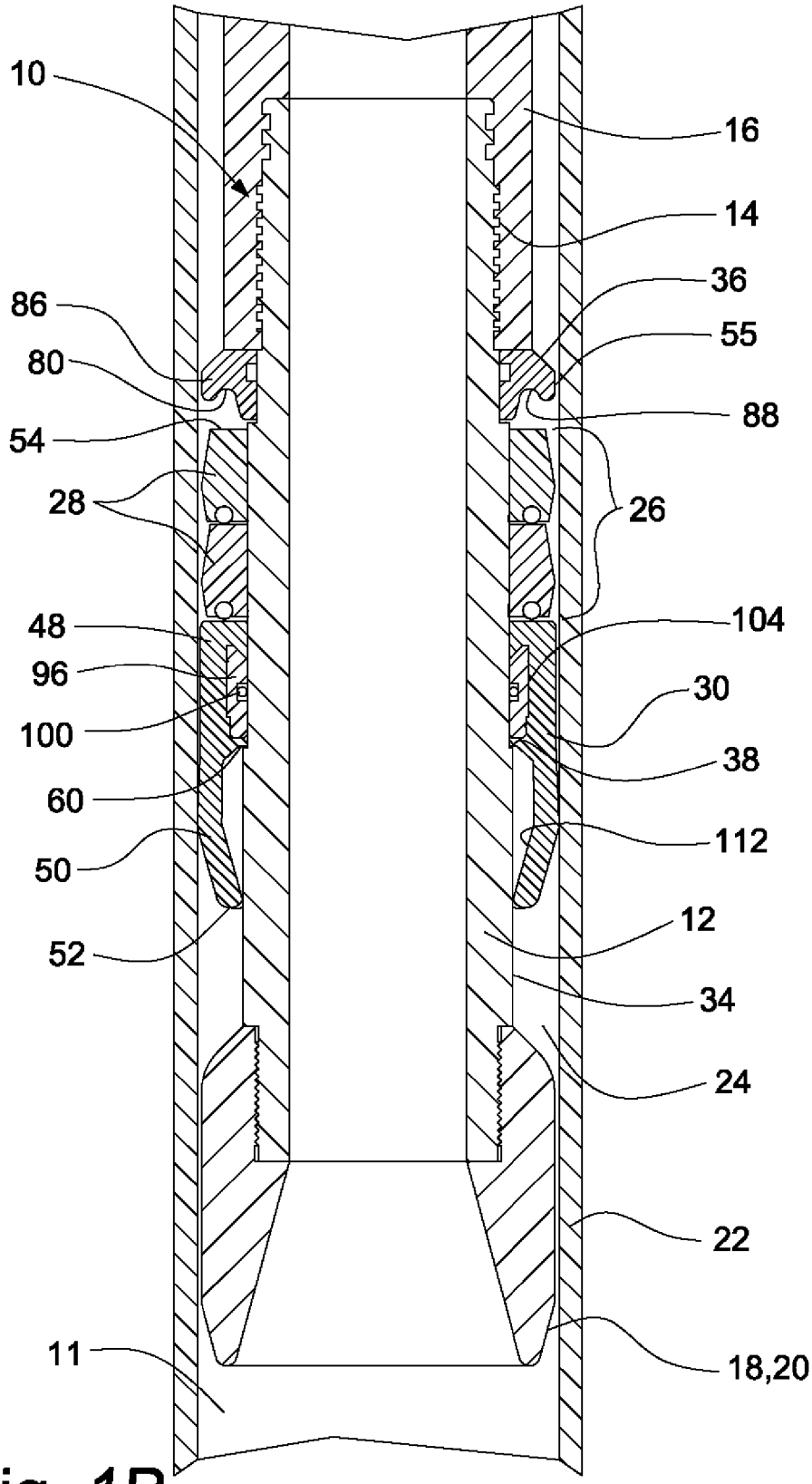
FIGS. 1B and 1C are cross-sectional views of packoff nipples according to FIG. 1, with the packoff nipples positioned in a well pipe and in a non-actuated condition (FIG. 1B) and in an actuated condition (FIG. 1C)
Figure 1C:
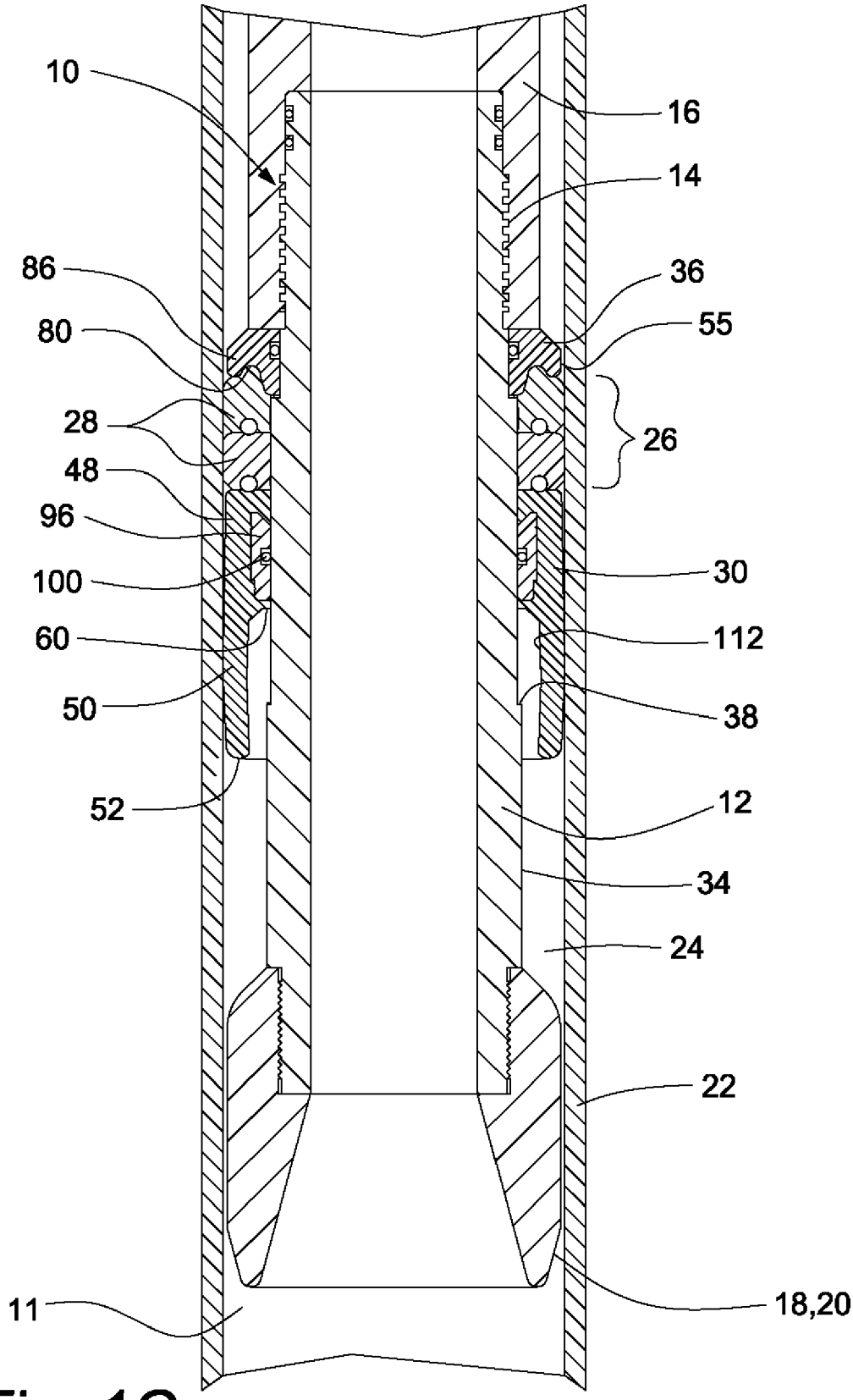

In another embodiment and as best seen in FIGS. 1A-C, a backup sleeve seal can be provided to reduce or eliminate load on the sleeve bond and thereby prevent seal failure. In particular, elastomeric material of the mounting portion of the packer cup 30 extends radially inwardly below the sleeve, thereby providing for improved seal of the mounting portion and sleeve when the packer cup 30 moves up the tubular body 12.

Figure 2A:
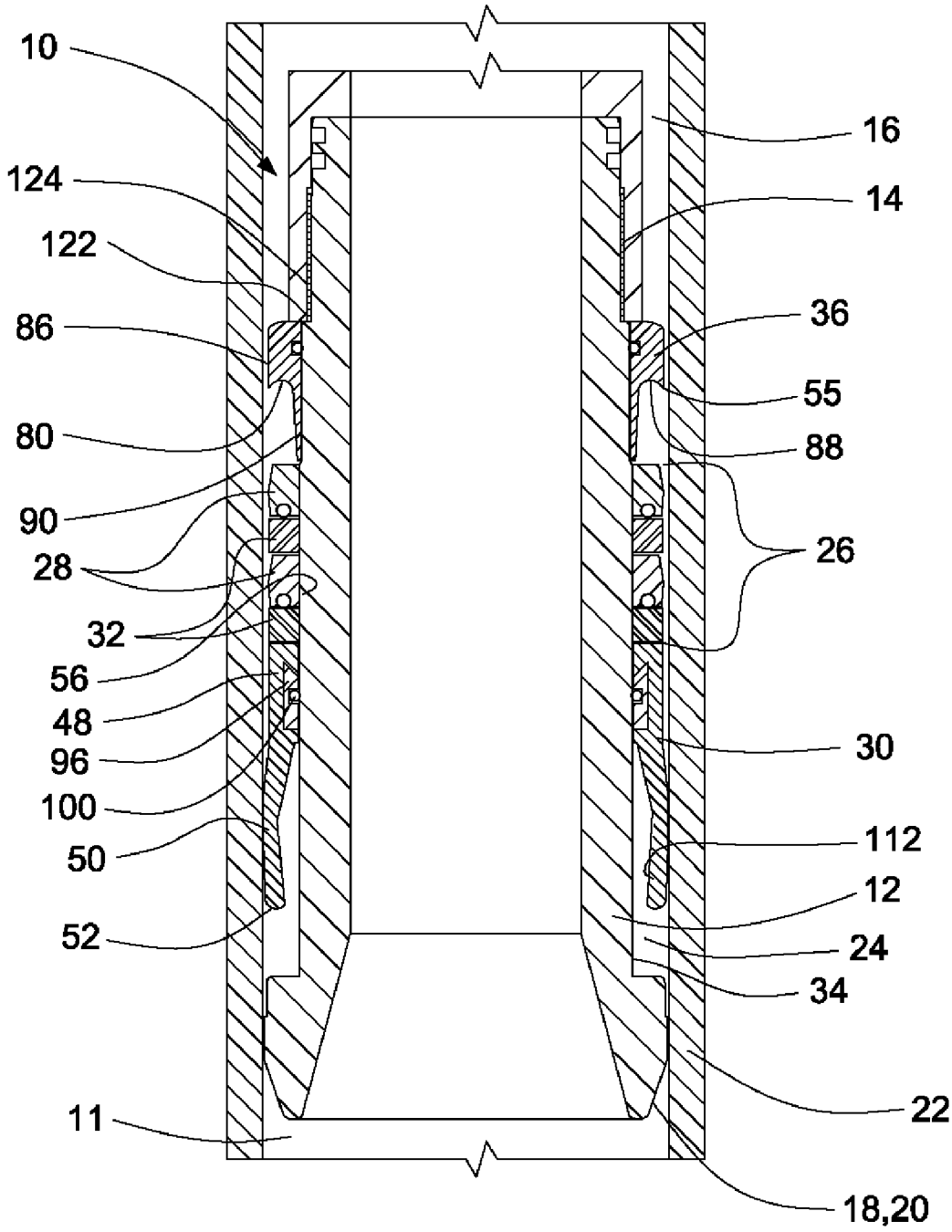
FIGS. 2A and 2B are cross-sectional views of another embodiment of a packoff nipple of the present invention, with the packoff nipple positioned in a well pipe and in a non-actuated condition (FIG. 2A) and in an actuated condition (FIG. 2B)
Figure 2B:
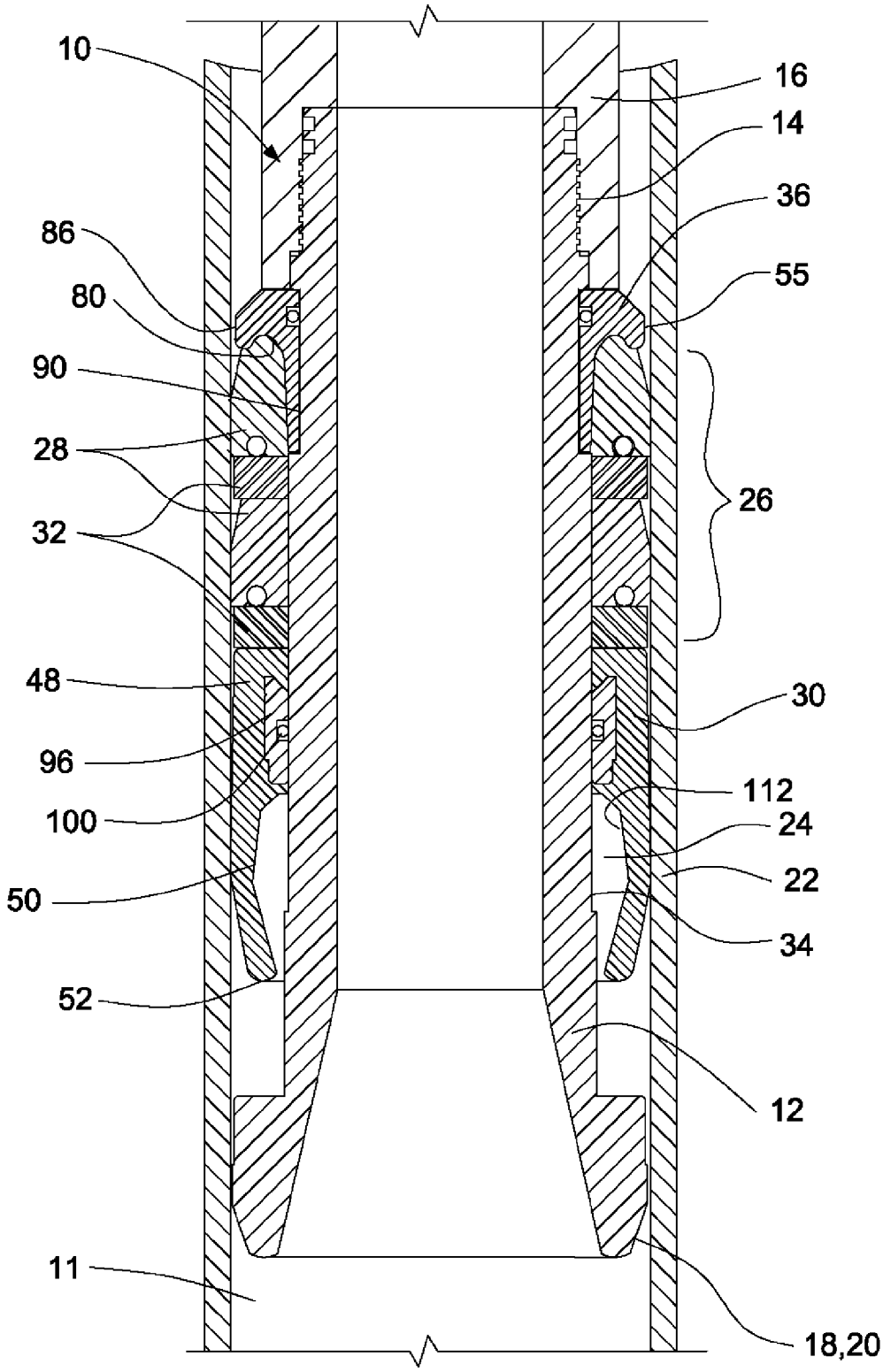
Figure 2C:
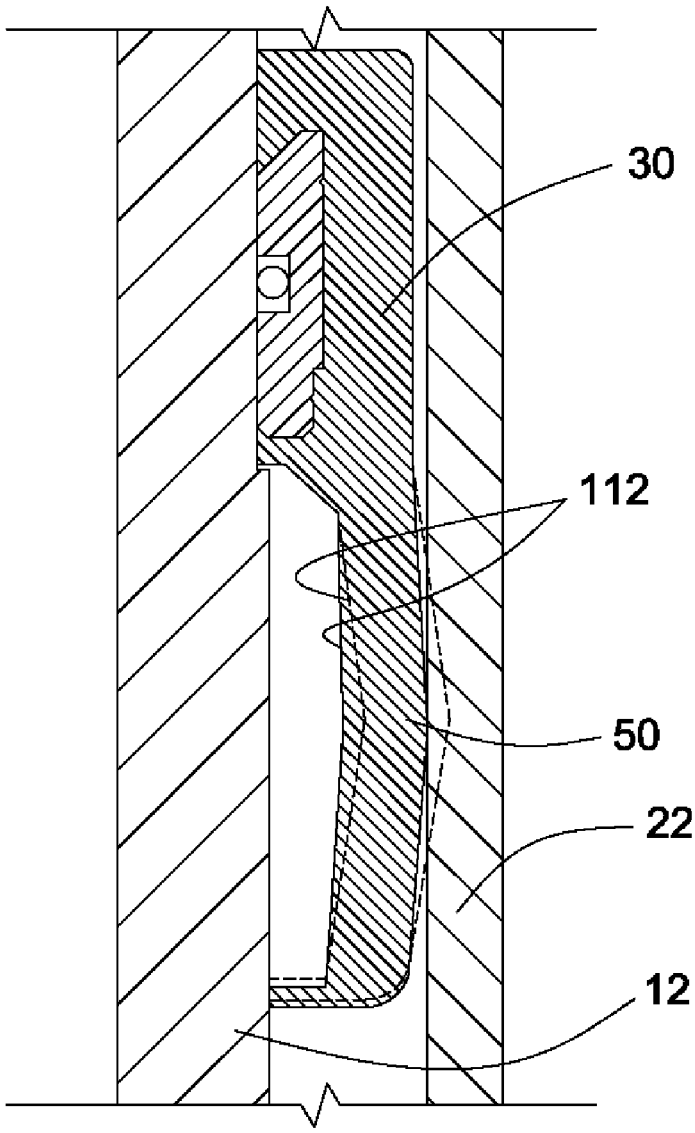
FIG. 2C is a partial cross-sectional view of a packer cup according to one embodiment of the invention, illustrating relaxed and engaged and positions in a well pipe.

While a conventional packer cup 30 can be used, and as shown in greater detail in FIG. 2C, it is preferable to profile an inner sidewall 112 of the skirt of the packer cup 30 to provide an inner arch or outwardly generally V-shaped profile. The packer cup has an elastomeric and annular mounting portion adapted for positioning to the tubular body and an elastomeric and annular skirt extending axially from the annular mounting portion and adapted to engage the well pipe to seal the annular space. As illustrated in dotted lines, before engaging the well pipe, the outer diametral extent of the skirt 50 is greater than the inner diameter of the well pipe. The inner sidewall 112 of the annular skirt has a radially outwardly, generally V-shaped profile which deflects inwardly when engaged with the well pipe. When engaged, as illustrated in solid lines, the radially compression of the skirt tends to open the cup and better exposing an internal annular relief between the tubular body 12 and the skirt 50 to downhole pressures. The internal annular relief permits the normal unrestrained outer diameter of the skirt 50 to be preferably greater than the inner diameter of the well pipe 22, thereby assisting in obtaining an initial seal even at low pressures and also assisting in obtaining a greater seal. In addition, the V-shape of the inner sidewall 112 also provides rigid support when the skirt 50 is flared with elevated pressure to assist in obtaining and maintaining a seal. The skirt 50 radially collapses under mechanical forces when entering and exiting well pipe restrictions. Consequently, the packer cup 30 will enter the well pipe 22 smoothly, reducing the likelihood of damage to the packer cup 30 and reducing the likelihood or extent of pre-activation of the sealing rings 28, as described above.

While it is preferable to use a packer cup 30 as the sealing ring assembly 26 actuator, other suitable actuators can be used as would be understood by one skilled in the art. For example, the actuator 30 could be an axially moveable ring (not shown) positioned around the tubular body 12 and below the sealing rings 28 which could be mechanically pulled upward to forcibly engage the downhole face 40 of a sealing ring 28.

Figure 11:
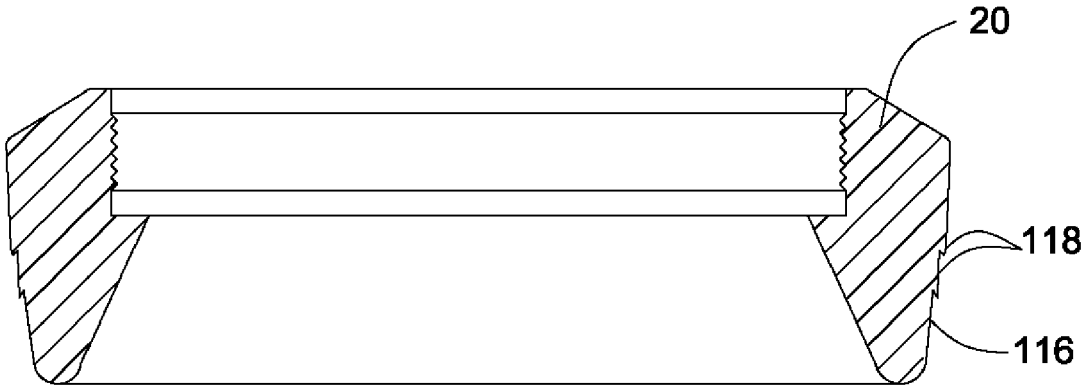
FIG. 11 is a cross sectional view of a bullnose end of a packoff nipple according to an embodiment of the present invention.

As previously mentioned, the bullnose 20 guides and centralizes the packoff nipple 10 as it enters the well pipe 22. With further reference to FIG. 11, a leading edge 116 of the bullnose 20 can have circumferential rings or teeth forming a serrated broach 118 for removing variable restrictions such as hydrates or arc-welding slag that can compromise the smooth entry of the packoff nipple 10 in the well pipe 22. The broach 118 can be made of any suitable material which provides a cutting surface that is harder than the pipe. Suitable materials for the broach 118 can include, for example, tungsten, heat treated, or nitrated teeth.

Preferably, the bullnose 20 is an exchangeable ring which can then be replaced if damaged. In addition, exchangeable bullnoses 20 of various outer diameters can be fit on a tubular body 12 to provide closer tolerances to the well pipe, thereby optimizing centralization of the packoff nipple and optimizing protection of the sealing rings 28 and packer cup 30 when entering the well pipe 22. Even further, where all components on the tubular body 12 are exchangeable, the same tubular body 12 can be used with well pipe 22 of various inner diameter, thereby providing a potential cost savings. As an additional convenience, the packer cup 30 and sealing rings 28 sized to a well pipe can be mounted on adapter sleeves (not shown) of various sizes which fit over the tubular body 12, rather than being mounted directly on tubular bodies 12 of varying sizes.

With reference to FIG. 2A, further structural advantage is achieved at the uphole end 14 of the tubular body 12 by providing a lower non-threaded overlapping and supporting portion for spacing a threaded portion 122 upwardly on the tubular body 12. Thus bending moments at any stress raiser 124 of the threaded portion 122 are reduced as the packoff nipple 10 is manipulated into and out of the well pipe 22, such that the threaded connection of the packoff nipple 10 to the mandrel 16 is less susceptible to breakage.

While the packoff nipple 10 has been described for sealing the annular sealing space 24 from upwardly directed pressures, one skilled in the art would appreciate that the packoff nipple 10 can also be oriented to seal annular sealing space 24 from downwardly directed pressures. In this case, all designated uphole and downhole orientations in the foregoing description would be reversed. Further, as one would understand that opposing orientation of two packoff nipples would constrain pressure therebetween.

EXAMPLE 1

The following exemplifies the outer diameters of various components of a packoff nipple 10 according to the present invention installed in well pipe 22 of an inner diameter of 2.441 inches.

| Component | O.D. (inches) |
|---|---|
| Tubular body 12 | 1.870 |
| Uphole stop 36 | 2.370 |
| Sealing ring (midsection) 62 | 2.390 |
| Spacer 32 | 2.370 |
| Packer cup skirt (midsection) 64 | 2.500 |
| Packer cup skirt (bottom) 52 | 2.360 |
| Bullnose 20 | 2.395 |

EXAMPLE 2

The following exemplifies the outer diameters of a various components for a packoff nipple 10 according to the present invention installed in well pipe of an inner diameter of 4.892 inches.

| Component | O.D. (inches) |
|---|---|
| Tubular body 12 | 3.750 |
| Uphole stop 36 | 4.850 |
| Sealing ring (midsection) 62 | 4.825 |
| Spacer 32 | 4.850 |
| Packer cup skirt (midsection) 64 | 4.975 |
| Packer cup skirt (bottom) 52 | 4.800 |
| Bullnose 20 | 4.875 |

Although preferred embodiments of the invention have been described in some detail herein above, those skilled in the art will recognize that various substitutions and modifications of the invention may be made without departing from the scope of the invention.

What is claimed is:

1. A packoff nipple for sealing an annular space in a well pipe comprising:

a tubular body, the tubular body adapted to be positioned within a bore of the well pipe, the annular space being formed between the tubular body and the well pipe;

an uphole stop, having a concave stop surface, positioned around the tubular body, the uphole stop having a downwardly depending lip spaced radially and outwardly from the tubular body;

a packer cup positioned around the tubular body and axially moveable therealong, the packer cup comprising an elastomeric mounting portion for positioning of the packer cup around the tubular body and an elastomeric skirt downwardly depending from the mounting portion and having an open bottom end; and a sealing assembly positioned around the tubular body and axially moveable therealong, the sealing assembly comprising one or more axially compressible elastomeric sealing rings, each sealing ring having a downhole face with a circumferential groove formed therein and an expansion portion adjacent the circumferential groove;

wherein elevated fluid pressure in the annular space below the packer cup causes the skirt to seal the annular space and to further cause the packer cup to move slidably towards the seal assembly; and wherein movement of the packer cup towards the sealing assembly axially compresses the sealing assembly and causes at least the expansion portion of the sealing rings to expand radially to seal the annular space and the sealing assembly to move along the tubular body until a top portion of the sealing assembly adjacent the uphole stop contacts the uphole stop and the downwardly depending lip actuates the top portion into its actuated condition, for formfitting the top portion into the uphole stop, constraining the top portion within the uphole stop and away from the wellpipe, avoiding extrusion of the sealing assembly.

2. The packoff nipple of claim 1 wherein the uphole stop forms an uphole stop surface extending substantially across the annulus for the contact with a top of a sealing ring adjacent the uphole stop surface.

3. The packoff nipple of claim 1 further comprising an expansion ring positioned around the tubular body and between the sealing assembly and the stop, the one or more sealing ring being slidably moveable substantially over the expansion ring to radially outwardly expand the at least one sealing ring.

4. The packoff nipple of claim 3 wherein the expansion ring is integrally formed with the stop.

5. The packoff nipple of claim 3 wherein the expansion ring comprises a radially outwardly tapering surface to the stop.

6. The packoff nipple of claim 1 further comprising an O-ring positioned within the circumferential groove of the one or more sealing rings.

7. The packoff nipple of claim 1 wherein an outer sidewall of the one or more sealing ring has an outwardly extending, generally V-shaped, profile.

8. The packoff nipple of claim 1 wherein the sealing assembly further comprises at least one tubular rigid spacer positioned around the tubular body for axial movement therealong, the rigid spacer positioned between the packer cup and a sealing ring adjacent the packer cup or between adjacent sealing rings.

9. The packoff nipple of claim 1 wherein the sealing assembly comprises a plurality of stacked sealing rings.

10. The packoff nipple of claim 1 wherein an inner sidewall of the skirt has a radially outwardly, generally V-shaped profile.

11. The packoff nipple of claim 1 wherein a rigid sleeve is securely inset within the elastomeric mounting portion and sealably and movably slidable adjacent the tubular body, the rigid sleeve having an upper radial compression surface formed between the rigid sleeve and the tubular body.

12. The packoff nipple of claim 1 further comprising:

a first packoff nipple; and a second packoff nipple connected coaxially with the first packoff nipple.

13. The packoff nipple of claim 12 wherein an uphole end of the tubular body of the first packoff nipple is connected to a downhole end of the tubular body of the second packoff nipple.

14. The packoff nipple of claim 13 wherein the first packoff nipple and the second packoff nipple are integrally formed.

15. The packoff nipple of claim 1 wherein the one or more axially compressible elastomeric sealing rings comprises a stack of two or more adjacent elastomeric sealing rings, one of which has a top portion adjacent the uphole stop, the stack of two or more adjacent elastomeric sealing rings having a pressure face which faces the packer cup, the pressure face having the circumferential groove.

16. The packoff nipple of claim 15 further comprising:

a lower packoff nipple; and an upper packoff nipple, the uphole end of the tubular body of the lower packoff nipple connected coaxially to the downhole end of the tubular body of the upper packoff nipple, the upper packoff nipple further comprising an expansion ring positioned around the tubular body and between the sealing ring assembly and uphole stop, an upper sealing ring of the two or more sealing rings being slidably moveable over the expansion ring to radially outwardly expand the upper sealing ring.

17. The packoff nipple of claim 15 wherein the downhole end forms a bullnose end and wherein the bullnose end has a broach along a leading edge for reaming an inner wall of the well pipe forming the bore when the packoff nipple enters the well pipe.

* * * * *